US007963616B2

(12) United States Patent
Weaver et al.

(10) Patent No.: US 7,963,616 B2
(45) Date of Patent: Jun. 21, 2011

(54) ROTARY CUTTING PICK

(75) Inventors: Steven Lee Weaver, New South Wales (AU); Matthew Kenny, New South Wales (AU)

(73) Assignee: Sandvik Intellectual Property AB, Sandvik (SE)

( * ) Notice: Subject to any disclaimer, the term of this patent is extended or adjusted under 35 U.S.C. 154(b) by 437 days.

(21) Appl. No.: 12/003,204

(22) Filed: Dec. 20, 2007

(65) Prior Publication Data

US 2008/0164747 A1 Jul. 10, 2008

(30) Foreign Application Priority Data

Dec. 20, 2006 (AU) ..... 2006-252152

(51) Int. Cl.
*E21C 35/183* (2006.01)

(52) U.S. Cl. ..... 299/113; 299/105; 299/106

(58) Field of Classification Search ..... 299/111, 299/113, 105, 104, 106, 107
See application file for complete search history.

(56) References Cited

U.S. PATENT DOCUMENTS

| | | | | |
|---|---|---|---|---|
| 4,149,753 | A * | 4/1979 | Stoltz et al. | 299/107 |
| 5,417,475 | A * | 5/1995 | Graham et al. | 299/105 |
| 6,113,195 | A | 9/2000 | Mercier et al. | |
| 7,172,256 | B2 | 2/2007 | Sleep et al. | |
| 7,530,642 | B2 * | 5/2009 | Ferreri et al. | 299/104 |
| 2005/0212345 | A1 * | 9/2005 | Sleep et al. | 299/105 |

FOREIGN PATENT DOCUMENTS

| | | |
|---|---|---|
| AU | 2004201284 | 10/2005 |
| DE | 42 26 976 | 2/1993 |
| EP | 0 274 645 | 7/1988 |
| GB | 2 258 876 | 2/1993 |

* cited by examiner

*Primary Examiner* — John Kreck
(74) *Attorney, Agent, or Firm* — Drinker Biddle & Reath LLP

(57) ABSTRACT

A cutting pick comprising an elongate shank and a cutting tip which is mounted to one end of the shank to project from that end. At least two sleeve segments are provided and those segments are circumferentially fixed about the shank to form a substantially annular sleeve. The sleeve can be fixed about the shank in non-contacting relationship with the trailing end of the cutting tip. Moreover, the cutting tip can have a portion of maximum diameter which is of greater diameter than the inner diameter of the sleeve so that the portion of maximum diameter overlies the sleeve radially.

32 Claims, 2 Drawing Sheets

ROTARY CUTTING PICK

RELATED APPLICATION DATA

This application claims priority under 35 U.S.C. §119 and/or §365 to Australian patent application No. 2006252152, filed Dec. 20, 2006, the entire contents of which are incorporated herein by reference.

FIELD

The present disclosure relates to a rotary cutting pick used in mining and excavation equipment, which has been developed principally for use in the mining of coal and in that use, typically underground coal mining. It will therefore be convenient to describe the disclosed rotary cutting pick and methods in relation to that use, although it should be appreciated that the disclosed rotary cutting pick and methods could be employed in alternative mining or excavation operations.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Underground coal mining presents various safety issues, one of these being the prevention of fires or explosions occurring within the mine. These can occur due to the generation during mining of methane gas and coal dust (commonly known as mine dust), which can be trapped within the mine and is readily ignitable. Disadvantageously, the equipment used in coal mining can generate incendive sparks which can ignite such gas or dust. Therefore, mine operators attempt to minimise or eliminate the production of sparks underground.

Rotary cutting picks are employed in rotary cutters, which include a rotating drum carrying a plurality of picks. Excavation is performed by the picks biting into an earth face as they rotate with the drum. This highly aggressive engagement between the picks and the earth face can result in spark production between them.

Cutting picks employed for coal mining generally have a hard cemented tungsten carbide tip that is fixed, usually by brazing, to a steel shank. Picks of this kind are disclosed in various prior art, such as U.S. Pat. No. 6,113,195, EP 0274645 and DE 4226976. The tip of the picks can be either of the insert or cap style.

The insert style is shown in DE 4226976, in which a greater section of the axial length of the tip is anchored within a bore of the shank, than extends out of the bore. The cap style is shown in EP 0274645, in which the tip has a broader base than the insert style tip and the base is located and brazed into a relatively shallow recess in the forward end of the shank. The present invention is applicable to cap style picks.

In picks of the above kind, sparks can be produced between the tungsten carbide tip and the earth face and also between the steel shank and the earth face, although there typically is greater likelihood of spark production between the steel shank and the earth face.

The highly aggressive environment in which the picks operate also results in wear of parts of the pick that come into contact with the earth being mined. Typically the shank of a pick is formed of a material that is softer than the tip of the pick and therefore the shank is more likely to be subject to wear than the tip and this is particularly the case closer to the tip.

An annular sleeve, attached to the shank of the cutting pick adjacent the cutting tip has been proposed for spark reduction. See for example in Applicant's co-pending Australian patent application no. 2004201284. The present invention relates to a similar form of cutting pick, providing an arrangement to reduce the incidence of engagement of the sleeve with the earth face and/or with earth fragments dislodged during mining, in order to prolong the life of the sleeve against failure.

SUMMARY

An exemplary cutting pick comprises an elongate shank, a cutting tip mounted to one end of the shank to project from that end, and at least two sleeve segments which are circumferentially fixed about the shank to form a substantially annular sleeve having leading and trailing ends.

An exemplary embodiment of a cutting pick comprises an elongate shank, a cutting tip mounted to one end of the shank to project from that end, the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter, and at least two sleeve segments which are fixed about the shank to form a substantially annular sleeve having an inner diameter and leading and trailing ends, the sleeve being fixed about the shank adjacent to and in non-contacting relationship with the trailing end of the cutting tip, wherein the portion of maximum diameter of the cutting tip is of greater diameter than the diameter of the inner diameter of the sleeve so that the portion of maximum diameter overlies the sleeve radially.

An exemplary method of mining with a cutting pick comprises the step of mining in gas and/or mine dust containing environments, wherein the cutting pick is attached to a mining machine and wherein the cutting pick comprises an elongate shank, a cutting tip mounted to one end of the shank to project from that end, the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter and at least two sleeve segments which are fixed about the shank to form a substantially annular sleeve having an inner diameter and leading and trailing ends, the sleeve being fixed about the shank adjacent to and in non-contacting relationship with the trailing end of the cutting tip, wherein the portion of maximum diameter of the cutting tip is of greater diameter than the diameter of the inner diameter of the sleeve so that the portion of maximum diameter overlies the sleeve radially.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
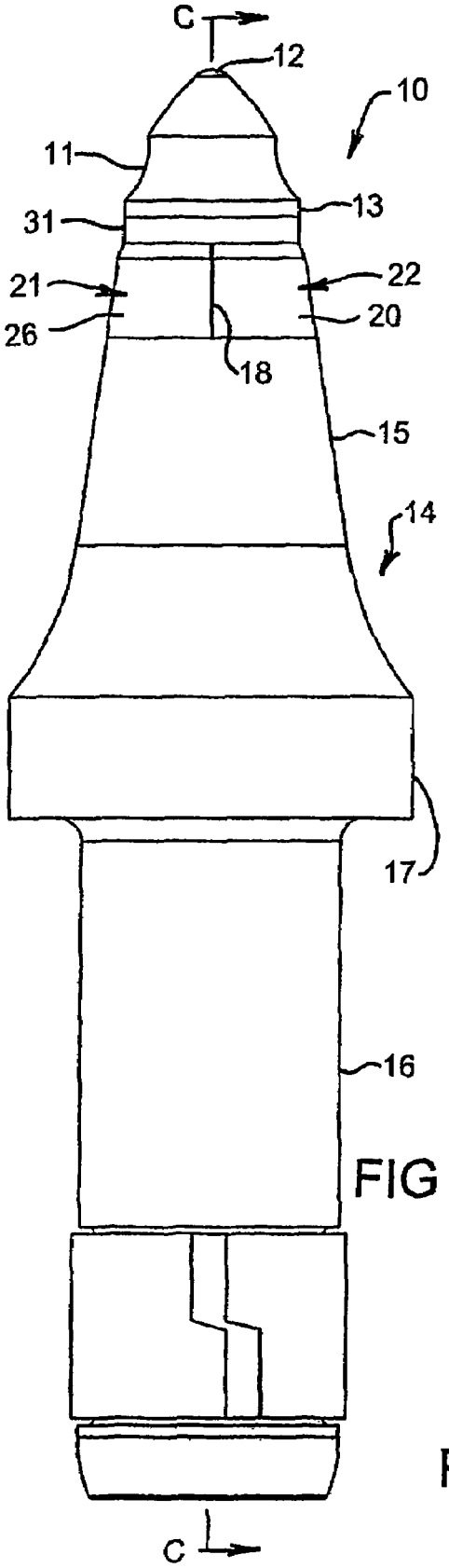
FIG. 1 is a side view of a cutting pick according to one embodiment of the invention.

According to the present disclosure, there is provided a cutting pick comprising an elongate shank, a cutting tip mounted to one end of the shank to project from that end, and at least two sleeve segments which are circumferentially fixed about the shank to form a substantially annular sleeve having leading and trailing ends.

A significant advantage is provided by forming the sleeve from at least two sleeve segments. Firstly, it allows the sleeve to be applied to the shank in circumstances where a sleeve formed as a continuous or closed ring could not be applied. For example, an embodiment of the cutting pick that will be discussed later herein includes a circumferential recess which is formed in the surface of the shank. The diameter of the recess in one embodiment is less than the diameter of the shank on either side of the recess. In this arrangement, a sleeve formed as a continuous or closed ring could not be seated within the recess, yet a sleeve formed from two or more sleeve segments can be.

Additionally, a sleeve formed of two or more sleeve segments can be fixed to the shank after the cutting tip has been attached to the shank. This is not possible for a sleeve formed as a continuous or closed ring, as such a sleeve could not be moved over the maximum diameter of the cutting tip which is greater than the inner diameter of the sleeve.

Because the sleeve segments can be applied to the shank in the manner described above, the inner diameter of the sleeve can be reduced compared to other forms of cutting picks. This allows the shank of the cutting pick to be more slender, or less bulky than other forms of cutting pick. The advantage here is that a more slender shank is less susceptible to engagement with the earth face being mined or with earth fragments that have been dislodged, so that sleeve wear is reduced as is the propensity for spark generation.

Exposure of the sleeve to engagement with the earth face being mined or excavated, or with fragments of earth which have been dislodged by the pick is also reduced in exemplary embodiments of the disclosed cutting pick by having the portion of maximum diameter of the cutting tip a diameter greater than the inner diameter of the sleeve. That portion of maximum diameter can at least partly overlie the sleeve radially and, therefore, can deflect earth fragments away from engagement with the sleeve. In some prior art cutting picks, the maximum diameter of the cutting tip is less than the inner diameter of the sleeve, so that the cutting tip provides no overlying protection to the sleeve by engagement with the earth face, or with earth fragments dislodged by the pick. Such an arrangement is acceptable in some mining or excavation environments, but in more aggressive environments, protection of the sleeve is desirable, to reduce the likelihood of its fracture. Even though the sleeve is protected in this manner, it can still adequately perform its primary function of wear and/or spark reduction, but with less likelihood of failure.

Accordingly, the sleeve can provide either or both of wear protection and spark protection, depending on the sleeve construction, more reliably through the life of the cutting pick.

The sleeve can be provided either for wear protection, or for spark reduction or for a combination of both. If wear protection is required, then the sleeve can be of any suitable material, such as of the same material as the shank, or of a harder material. The sleeve can be of the same material as the cutting tip for example and in that arrangement, the sleeve could be formed from tungsten carbide.

The sleeve is preferably fixed about the shank adjacent to the trailing end of the cutting tip, as that is the position of the shank which is most likely to contact either the earth face being cut, or the earth fragments which have been dislodged from the face during cutting. Thus, it is that region of the shank which is most likely to wear and/or to generate an incendive spark. The shank is usually less likely to come into contact with the earth face or earth fragments further away from the cutting tip, so that the provision of a sleeve is only required for a small portion of the shank adjacent the cutting tip, for either of wear and/or spark reduction.

If the sleeve is provided for spark protection, then the sleeve should be made of a material which has a lower propensity for incendive spark production during a cutting operation than the material of the shank. Again, the sleeve can be formed from the same material as the cutting tip if that material has the characteristics for spark resistance, and such a material could be tungsten carbide.

The sleeve segments which form the substantially annular sleeve can comprise two sleeve segments, which are each arcuate segments spanning approximately 180°. Thus, the sleeve segments can each be semi-circular segments.

In a preferred arrangement, the sleeve is comprised of a pair of sleeve segments. However, it is within the scope of the present invention, that the sleeve be formed of three or more sleeve segments each having a circumferential extension of not more than approximately 180°.

In a preferred arrangement, the cutting tip has a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter and the sleeve segments are fixed about the shank adjacent to and in non-contacting relationship with the trailing end of the cutting tip.

It is further preferred that the portion of maximum diameter of the cutting tip is of greater diameter than the diameter of the inner diameter of the sleeve so that the portion of maximum diameter overlies the sleeve radially.

In the disclosed cutting pick, the elongate shank can take any suitable form, such as known forms, for fixing to a rotary cutting drum. The shank would usually be releasably fixable to the drum so that worn cutting picks can be replaced as necessary and in some machinery, the shank is rotatably mounted so that the cutting pick can freely rotate about its lengthwise axis as it engages an earth face. The shank usually would be manufactured from steel.

In an embodiment of the disclosed cutting pick, the shank can be configured to receive a cap style cutting tip. The cutting tip can be manufactured from any suitable material preferably which is harder than the shank material, and the preferred cutting tip material is cemented tungsten carbide. The tip can also be diamond impregnated for increased hardness or can include cubic boron nitride for the same purpose. The cutting tip can have any suitable shape. The cutting tip usually is brazed to the shank, although other arrangements for fixing the tip, such as by chemical adhesives, can be employed.

The sleeve which is fixed about the shank adjacent the cutting tip preferably is formed from the same material as the cutting tip and preferably that material is a cemented tungsten carbide. Alternatively, the material could be or include SiC, $Al_2O_3$, TiN, SiC-D (silicon carbide diamond composite), cubic boron nitride, tool steel, or other like materials. These materials can be formed as a composite material with other suitable materials, or they may be provided as an outer layer or layers over a suitable base.

It is preferred that the sleeve as formed, has a constant inner diameter through its axial length. However, the inner diameter of the sleeve can vary throughout its axial length to suit the shape of the shank face to which it is fixed. For example, the shank face may be an inclined face and the inner diameter of the sleeve will then increase from one axial end to the other. Alternatively, the shank face may be stepped or otherwise shaped and therefore the inner diameter of the sleeve can be varied to match.

In a preferred embodiment, the sleeve has a wall thickness which increases from the region of the leading end thereof to the region of the trailing end. In this preferred arrangement, the inner diameter of the sleeve can be constant throughout its axial length, while the outer diameter of the sleeve increases from the region of the leading end to the region of the trailing end. In the preferred arrangement, the leading end of the sleeve is bevelled.

In a preferred arrangement, the sleeve segments are fixed about the shank by a fixing compound and those segments extend about the shank for substantially 360°. The fixing compound can be any suitable compound, but is preferably a solder or braze. In the preferred arrangement, the fixing compound has a lower propensity for incendive spark production during a cutting operation than the material of the shank.

In a preferred embodiment, the shank can define a shoulder which extends substantially perpendicular to the lengthwise axis of the shank and the trailing end of the sleeve is supported on the shoulder.

The shoulder can form a first surface of a circumferential recess formed in the shank which is provided for at least partly accommodating the sleeve. By this arrangement, the sleeve can be supported inboard of an adjacent surface of the shank at one or both ends of the sleeve. In other words, the sleeve is recessed into the shank. Thus, the inner diameter of the sleeve can be less than that of the diameter of the shank at one or either end of the sleeve. Advantageously, the arrangement permits the sleeve to be applied to a recess formed in the shank, because the sleeve is formed by two or more separate sleeve segments which can be separately brought into position within the recess. This could not be achieved by a sleeve of the same size which is formed as a closed annular sleeve because that form of sleeve would not be able to fit over the shank portion which is adjacent the recess and which is of greater diameter than the internal diameter of the sleeve.

By fitting the sleeve into a recess, the bulk of the cutting pick below the tip can be reduced compared to other forms of cutting pick and this can have the advantages as expressed earlier herein, relating to reduction of sparking and sleeve failure.

The recess can include a second surface which is spaced from and preferably in facing relationship with the first surface and a bridging surface can extend between the first and second surfaces. Typically the first and second surfaces will be generally parallel and perpendicular to the bridging surface. The inner surface of the sleeve can be formed complementary to the surface shape of the bridging surface, and in the preferred arrangement, the bridging surface is of constant diameter.

In the above arrangement, the second surface can support the leading end of the sleeve so that the sleeve is supported at either end.

The sleeve segments can be fixed to the shank by any suitable fixing mechanism, although the preferred arrangement is by welding, solder or braze or a combination of these. Preferably there is fixing attachment between the inner surface of the sleeve and the facing surface of the shank such as the bridging surface of the recess described above, and preferably also between the trailing end of the sleeve to the shoulder. Fixing attachment can also be made between the leading end of the sleeve and the second surface, where the second surface is provided.

In a preferred embodiment, a shank portion is interposed between the leading end of the sleeve and the trailing end of the cutting tip. That shank portion preferably is formed as a flange and preferably forms a supporting surface for supporting the cutting tip.

It is within the scope of the present invention, that more than one sleeve can be fixed to the shank and for example, the invention encompasses an arrangement in which a sleeve which is formed in a continuous or closed ring is positioned adjacent a further sleeve which is formed by at least two sleeve segments. In this arrangement, the sleeve which is formed by the sleeve segments might be positioned in a region of the shank to which a continuous annular sleeve could not be fitted. Accordingly, the invention contemplates an arrangement in which there is a combination of sleeve parts, one or more of which are formed by continuous rings, and one or more of which are formed by two or more sleeve segments.

In a preferred form, the sleeve has a height of about 6 to 24 mm, preferably 12 mm.

In the preferred arrangement, the portion of maximum diameter of the cutting tip has a dimension of between 12 mm and 48 mm. More preferably, that diameter is between 23 mm and 24 mm.

Preferably, the inner diameter of the sleeve is between 10 mm and 40 mm. More preferably, the inner diameter of the sleeve is between 19 mm and 21 mm. As previously described, the inner diameter of the sleeve can change, such as if the inner diameter is stepped, or conical or otherwise shaped.

Preferably the wall thickness of the sleeve between radially inner and outer surfaces thereof, is between 2 mm and 8 mm. More preferably, the wall thickness of the sleeve is between 3 mm and 4 mm. In the preferred embodiment, the wall thickness of the sleeve increases from the leading end to the trailing end so that in cross-section, the sleeve is conical.

In one embodiment, the sleeve segments are sized so that facing ends of adjacent segments are spaced from contact with one another by a distance of about 0.1 mm to 2 mm, but the overall annular extent of the sleeve segments is such that the segments extend for about 360°. In this embodiment, it is preferred that the space between respective facing ends is substantially filled with a fixing compound, such as a solder or braze.

In a preferred embodiment, there is provided a cutting pick comprising an elongate shank, a cutting tip mounted to one end of the shank to project from that end, the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter, and at least two sleeve segments which are fixed about the shank to form a substantially annular sleeve having an inner diameter and leading and trailing ends, the sleeve being fixed about the shank adjacent to and in non-contacting relationship with the trailing end of the cutting tip, wherein the portion of maximum diameter of the cutting tip is of greater diameter than the diameter of the inner diameter of the sleeve so that the portion of maximum diameter overlies the sleeve radially.

The present disclosure further provides a method of using a cutting pick for mining. For example, the cutting pick can be attached to a mining machine. Such a cutting pick can, in exemplary embodiments, comprises an elongate shank, a cutting tip mounted to one end of the shank to project from that end, the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter, and at least two sleeve segments which are fixed about the shank to form a substantially annular sleeve having an inner diameter and leading and trailing ends, the sleeve being fixed about the shank adjacent to and in non-contacting relationship with the trailing end of the cutting tip, wherein the portion of maximum diameter of the cutting tip is of greater diameter than the diameter of the inner diameter of the sleeve so that the portion of maximum diameter overlies the sleeve radially.

Furthermore, the method comprises the step of mining in gas and/or mine dust containing environments. According to the method described above, the environment is one which preferably includes methane gas.

FIG. 1 is a side view of an exemplary embodiment of a cutting pick 10. The pick 10 includes a cutting tip 11 which has a leading end 12 and a trailing end 13. The cutting tip 11 is mounted to an elongate shank 14. The shank 14 includes a conical section 15 and a cylindrical section 16, which are separated by a collar 17. The cylindrical section 16 and the collar 17 are configured for mounting of the cutting pick 10 to a rotary cutting drum (not shown).

The cutting pick 10 further includes a sleeve 20 which extends about an upper portion of the conical section 15 and which is formed from two sleeve segments 21 and 22. The sleeve segment 21 is illustrated as a separate component in FIG. 3, although it is the case that the sleeve segments 21 and 22 are identical.

Figure 3:
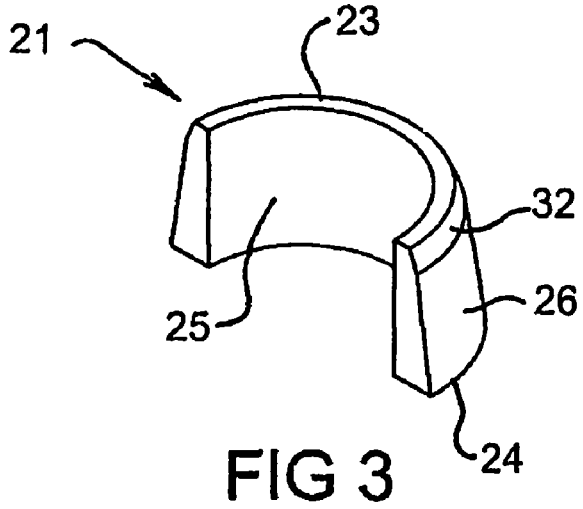
FIG. 3 is a perspective view of a sleeve segment which is applied to the cutting pick of FIGS. 1 and 2.

Referring to FIG. 3, it can be seen that the sleeve segment 21 is a semi-circular arcuate segment which spans about 180°. Accordingly, when the sleeve segments 21 and 22 are fitted to the conical section 15 of the shank 14, a substantially annular sleeve 20 is formed. It is to be noted that contact may or may not occur at the junction 18 between the sleeve segments 21, 22. Thus, there may be a small gap between the segments 21, 22, although that gap may be filled with solder or braze when the segments 21, 22 are fixed to the shank 14.

The sleeve segment 21 includes a leading end 23 and a trailing end 24. The sleeve segment 21 further has an inner surface 25 and an outer surface 26. Each of the sleeve segments 21 and 22 are fixed to the shank 14 adjacent to the tip 11, but in non-contacting relationship with the tip 11.

Figure 2:
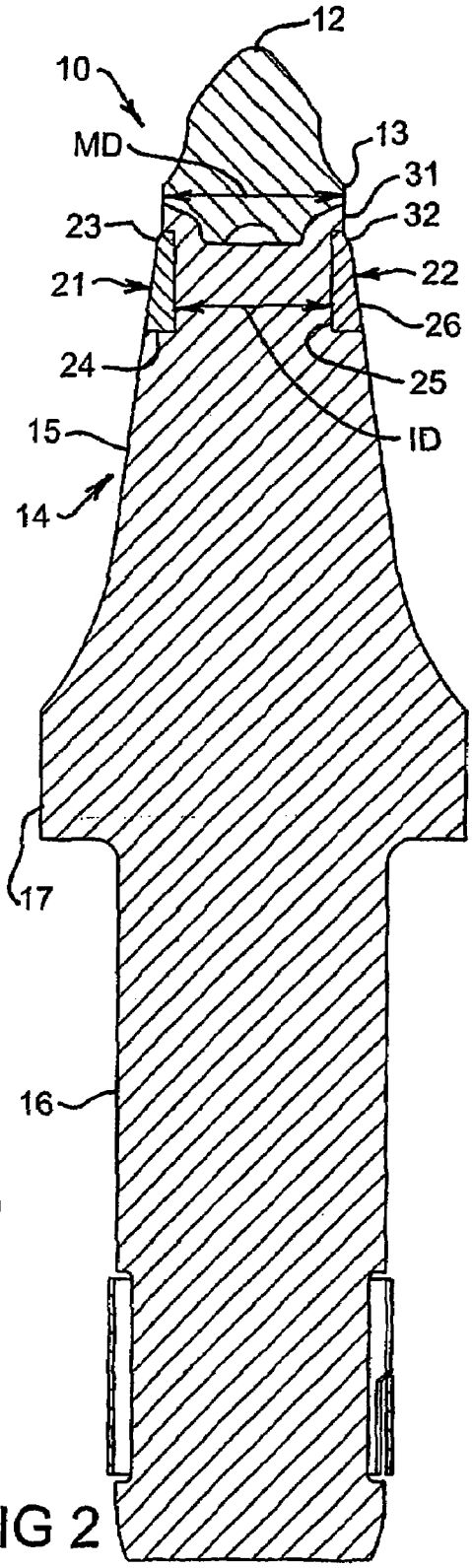
FIG. 2 is a cross-sectional view taken through section CC of FIG. 1.
Figure 4:
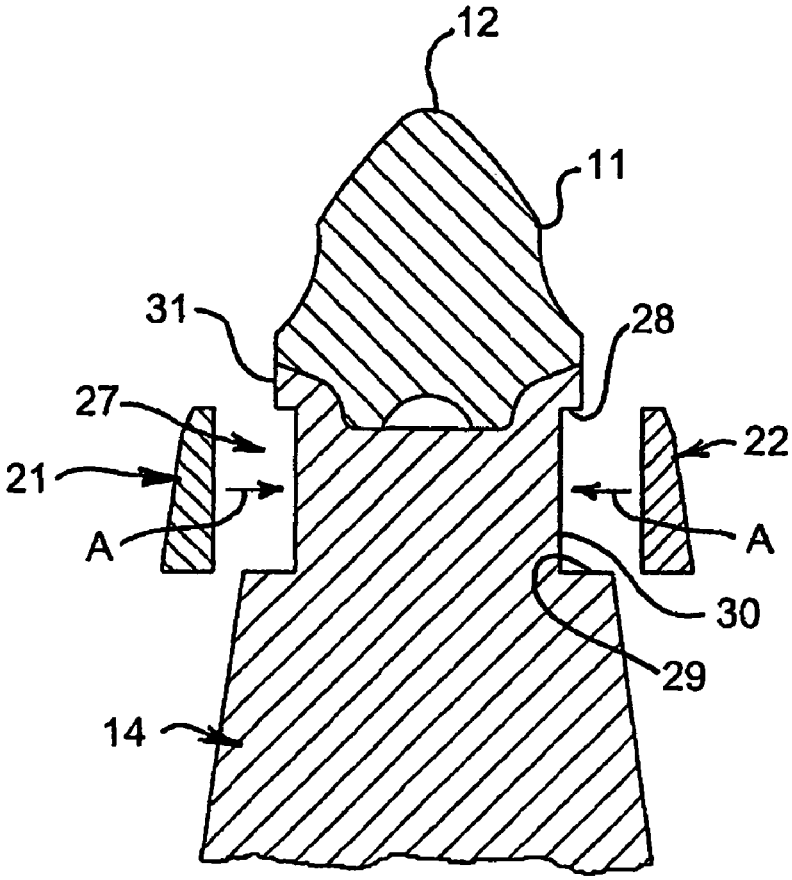
FIG. 4 is a part cross-sectional view of the cutting pick of FIGS. 1 and 2, showing the sleeve segments spaced from the cutting pick.

As shown in FIG. 2, the sleeve segments 21 and 22 are received within a circumferential annular recess 27 (see FIG. 4), formed by an upper shoulder 28, a lower shoulder 29 and a bridging surface 30. It will be clear that by providing a sleeve in two semi-circular segments, the sleeve can be partly or fully accommodated within the recess 27, which would not be possible if the sleeve was formed as a continuous or closed ring. Thus advantageously, the sleeve segments 21 and 22 can be fitted to the shank 14 in the direction shown in FIG. 4 by the arrows A and can be fixed to one or more of the upper and lower shoulders 28 and 29 and the bridging surface 30, such as by a suitable braze or solder. By this arrangement, the inner diameter ID (see FIG. 2), of the sleeve formed by the segments 21 and 22, can be less than the maximum diameter MD of the cutting tip 11. As expressed earlier, if the sleeve was formed as a continuous or closed ring, then its ID would have to be slightly greater than the MD of the tip 11. Accordingly, the sleeve formed by the segments 21 and 22 can have inner and outer diameters which are less than that which would be required if the sleeve was formed as a continuous or closed ring and therefore the portion of the cutting pick 10 which is immediately adjacent the trailing end 13 of the tip 11 can be more slender or less bulky, than in an arrangement which employs a sleeve formed as a continuous or closed ring. Because of this slenderness, the propensity for the cutting pick 10 at the sleeve segments 21 and 22 to engage either the earth face being mined, or fragments of the face which have been dislodged is lowered. Thus, sleeve failure is reduced, as is the propensity for spark generation.

Moreover, location of the sleeve segments 21, 22 in the recess 27 allows the sleeve segments 21, 22 to be securely located by engagement with each of the upper and lower shoulders 28 and 29. Still further, the cutting pick 10 includes an annular shank flange 31 which is interposed between the leading end 23 of the sleeve segments 21, 22 and the trailing end 13 of the cutting tip 11 so that the trailing end 13 is supported by the flange 31. The flange 31 is not however subject to significant exposure to engagement of the earth face being mined or to fragments of the face which have been dislodged, because the flange 31 is positioned in the "shadow" of the tip 11 and the shape of the tip 11 tends to direct fragments away from the flange 31.

The diameter of the flange 31 is greater than the ID of the sleeve 20, but is slightly less than the MD of the tip 11.

It will be apparent from FIGS. 2 and 3, that the inner surface 25 of the sleeve segments 21, 22 is cylindrical, or of constant diameter, and that the outer surface 26 is inclined, so that the wall thickness of the sleeve segments 21, 22 varies from the leading end 23 to the trailing end 24. As is clear from FIGS. 2 and 3, the wall thickness is greater at the trailing end 24 than at the leading end 23. This advantageously provides further protection for the sleeve segments 21, 22 in respect of wear and spark generation, by providing a profile which decreases in thickness towards the cutting tip 11. It is to be noted that the leading end 23 has a bevelled surface 32, again for the purpose of minimizing wear and spark generation.

Throughout the description of this specification the word "comprise" and variations of that word, such as "comprises" and "comprising", are not intended to exclude other additives or components or integers.

The cutting pick described herein is susceptible to variations, modifications and/or additions other than those specifically described and it is to be understood that the invention can include all such variations, modifications and/or additions which fall within the scope of the above description.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting pick comprising:

an elongate shank having a circumferential annular recess for at least partly accommodating a sleeve;

a cutting tip mounted to one end of the shank to project from that end; and at least two sleeve segments which are circumferentially fixed about the shank in the circumferential annular recess to form a substantially annular sleeve, the substantially annular sleeve having leading and trailing ends, an inner surface, an outer surface, an inner diameter, a maximum wall thickness, a minimum wall thickness, and an axial height, wherein the sleeve segments are fixed about the shank in the circumferential annular recess by a fixing compound and the sleeve segments extend about the shank for substantially 360°.

2. The cutting pick according to claim 1, wherein each sleeve segment has a circumferential extension of not more than approximately 180°, or wherein each sleeve segment is an arcuate segment of approximately 180°.

3. The cutting pick according to claim 1, wherein the substantially annular sleeve is formed from three or more sleeve segments.

4. The cutting pick according to claim 1, wherein the cutting tip has a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter; the sleeve segments being fixed about the shank in the circumferential annular recess adjacent to and in non-contacting relationship with the trailing end of the cutting tip.

5. The cutting pick according to claim 4, wherein the portion of maximum diameter of the cutting tip is of greater diameter than the diameter of the inner diameter of the substantially annular sleeve so that the portion of maximum diameter overlies the substantially annular sleeve radially.

6. The cutting pick according to claim 5, wherein the inner diameter of the substantially annular sleeve is constant through the axial length of the sleeve.

7. The cutting pick according to claim 1, wherein the substantially annular sleeve has a wall thickness which increases from the region of the leading end thereof to the region of the trailing end thereof.

8. The cutting pick according to claim 1, wherein the leading end of the substantially annular sleeve is bevelled.

9. The cutting pick according to claim 1, wherein the fixing compound is a solder or braze.

10. The cutting pick according to claim 1, wherein the fixing compound has a lower propensity for incendive spark production during a cutting operation than the material of the shank.

11. The cutting pick according to claim 1, wherein the substantially annular sleeve has a lower propensity for incendive spark production during a cutting operation than the material of the shank.

12. The cutting pick according to claim 1, wherein the circumferential annular recess comprises a shoulder in the shank which extends substantially perpendicular to the lengthwise axis of the shank.

13. The cutting pick according to claim 12, wherein the shoulder forms a first surface of the circumferential annular recess.

14. The cutting pick according to claim 13, wherein the circumferential annular recess includes a second surface, spaced from the first surface and a bridging surface extending between the first and second surfaces.

15. The cutting pick according to claim 14, wherein the second surface supports the leading end of the substantially annular sleeve.

16. The cutting pick according to claim 12, wherein the substantially annular sleeve is fixed about the shank by welding, brazing or soldering.

17. The cutting pick according to claim 1, wherein a shank portion is interposed between the leading end of the substantially annular sleeve and the trailing end of the cutting tip.

18. The cutting pick according to claim 17, wherein the shank portion forms a flange interposed between the substantially annular sleeve and the cutting tip.

19. The cutting pick according to claim 1, wherein the substantially annular sleeve is a composite formed of a plurality of sleeve parts wherein at least one of the sleeve parts is formed of at least two sleeve segments.

20. The cutting pick according to claim 4, wherein the portion of maximum diameter has a dimension of between 12 mm and 48 mm.

21. The cutting pick according to claim 20, wherein the portion of maximum diameter has a dimension of between 23 mm and 24 mm.

22. The cutting pick according to claim 1, wherein the inner diameter of the sleeve is between 10 mm and 40 mm.

23. The cutting pick according to claim 22, wherein the inner diameter of the sleeve is between 19 mm and 21 mm.

24. The cutting pick according to claim 1, wherein the minimum wall thickness of the substantially annular sleeve between the inner and outer surfaces is between 3 mm and 4 mm.

25. The cutting pick according to claim 1, wherein the maximum wall thickness of the substantially annular sleeve between the inner and outer surfaces is between 2 mm and 8 mm.

26. The cutting pick according to claim 1, wherein the axial height of the substantially annular sleeve is between 6 mm and 24 mm.

27. A cutting pick according to claim 26, wherein the axial height of the substantially annular sleeve is about 12 mm.

28. The cutting pick according to claim 1, wherein the sleeve segments are adjacent to each other and include facing ends not in contact with each other and separated by a distance, wherein the distance between the facing ends is about 0.1 mm to 2 mm.

29. The cutting pick according to claim 1, wherein the sleeve segments are fixed about the shank in the circumferential annular recess by a fixing compound and the sleeve segments extend about the shank for substantially 360°, wherein the sleeve segments are adjacent to each other and include facing ends not in contact with each other and separated by a distance, wherein the distance between the facing ends is about 0.1 mm to 2 mm, and is substantially filled with fixing compound.

30. A cutting pick comprising:

an elongate shank;

a cutting tip mounted to one end of the shank to project from that end; the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter; and at least two sleeve segments which are fixed about the shank to form a substantially annular sleeve having an inner diameter and leading and trailing ends, the substantially annular sleeve being fixed about the shank adjacent to and in non-contacting relationship with the trailing end of the cutting tip, wherein the portion of maximum diameter of the cutting tip is of greater diameter than the diameter of the inner diameter of the substantially annular sleeve so that the portion of maximum diameter overlies the substantially annular sleeve radially.

31. A method of mining with a cutting pick, the method comprising the step of:

mining in gas and/or mine dust containing environments, wherein the cutting pick is attached to a mining machine and wherein the cutting pick comprises:

an elongate shank;

a cutting tip mounted to one end of the shank to project from that end, the cutting tip having a leading end, a trailing end and a mounting portion for mounting to the shank, the mounting portion and the leading end being disposed on opposite sides of the trailing end, the tip having a shape such that it diverges outwardly in a direction from the leading end to the trailing end to a portion of maximum diameter; and at least two sleeve segments which are fixed about the shank to form a substantially annular sleeve having an inner diameter and leading and trailing ends, the substantially annular sleeve being fixed about the shank adjacent to and in non-contacting relationship with the trailing end of the cutting tip, wherein the portion of maximum diameter of the cutting tip is of greater diameter than the diameter of the inner diameter of the substantially annular sleeve so that the portion of maximum diameter overlies the sleeve radially.

32. The method of claim 31, wherein the environment includes methane gas.

* * * * *